US010369781B2

(12) United States Patent
Brassil et al.

(10) Patent No.: US 10,369,781 B2
(45) Date of Patent: Aug. 6, 2019

(54) MOBILE PRINTERS

(71) Applicant: HEWLETT-PACKARD DEVELOPMENT COMPANY, L.P., Houston, TX (US)

(72) Inventors: John T Brassil, Princeton, NJ (US); Andy Liao, San Diego, CA (US); Vijay Nayak, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/535,851

(22) PCT Filed: Jan. 8, 2015

(86) PCT No.: PCT/US2015/010577

§ 371 (c)(1),
(2) Date: Jun. 14, 2017

(87) PCT Pub. No.: WO2016/111688

PCT Pub. Date: Jul. 14, 2016

(65) Prior Publication Data

US 2017/0334195 A1 Nov. 23, 2017

(51) Int. Cl.
*B41J 2/045* (2006.01)
*B41J 3/36* (2006.01)
(Continued)

(52) U.S. Cl.
CPC ..... *B41J 2/04508* (2013.01); *B41J 2/04586* (2013.01); *B41J 2/2135* (2013.01);
(Continued)

(58) Field of Classification Search
CPC ..... B41J 2/2135; B41J 2/04541; B41J 2/04581; B41J 2/04508; B41J 2/2142; B41J 3/36; B41J 29/023
See application file for complete search history.

(56) References Cited

U.S. PATENT DOCUMENTS 6,577,299 B1 6/2003 Schiller et al.
7,748,839 B2 * 7/2010 Noe ..... B41J 3/36 347/109

(Continued)

FOREIGN PATENT DOCUMENTS

EP 1259058 A2 11/2002

OTHER PUBLICATIONS

"Efficient Solutions for the Printing Industry", Sep. 19, 2012.
"Miniature Housings in the Application", Jun. 22, 2011.

*Primary Examiner* — Thinh H Nguyen
(74) *Attorney, Agent, or Firm* — HP Inc. Patent Department

(57) ABSTRACT

A mobile printer includes an ultrasound sensor to sense a set of ultrasonically-sensed positional data points of a print nozzle of the printer, at least one optical sensor to sense a set of optically-sensed positional data points of the print nozzle, and a processor. The processor is to apply a correction function on the set of ultrasonically-sensed positional data points and on the set of optically-sensed positional data points to provide a set of corrected positional data points of the print nozzle and is to cause the print nozzle to deposit according to a print request and according to the set of corrected positional data points.

20 Claims, 4 Drawing Sheets

(51) Int. Cl.
*B41J 29/02* (2006.01)
*B41J 2/21* (2006.01)

(52) U.S. Cl.
CPC ..... *B41J 2/2142* (2013.01); *B41J 3/36* (2013.01); *B41J 29/023* (2013.01); *B41J 2/04573* (2013.01)

(56) References Cited

U.S. PATENT DOCUMENTS

| | | | | |
|---|---|---|---|---|
| 9,446,585 | B2 * | 9/2016 | Goyal | B41J 3/36 |
| 2003/0001912 | A1 | 1/2003 | Kusunoki | |
| 2006/0082557 | A1 | 4/2006 | Ericson et al. | |
| 2007/0248367 | A1 | 10/2007 | Fuchs | |
| 2008/0213018 | A1 | 9/2008 | Mealy et al. | |
| 2013/0257984 | A1 | 10/2013 | Druckmashinen | |
| 2013/0286073 | A1 | 10/2013 | Blessing et al. | |

* cited by examiner

MOBILE PRINTERS

BACKGROUND

Printers are electrical devices, such as computer peripherals, which make human-readable representations of graphics or text on paper or physical media. Printers generally operate by using a print nozzle to deposit inks at predetermined positions on a printing surface of the medium to form an image. Mobile printers are printers that are portable and compact that permit printing on unconventional and traditional media at arbitrary orientations.

BRIEF DESCRIPTION OF THE DRAWINGS

The following detailed description references the drawings, wherein.

DETAILED DESCRIPTION

Traditional printers control the orientation of the printing medium and therefore can effectively position a printer's print nozzles to determined locations on the printing surface. When ink is accurately deposited onto the printing surface, a precise printed product can be formed. Considerable physical space, operational complexity, and cost of a conventional desktop printer is dedicated to the precise positioning of the print nozzles. Furthermore, traditional printers limit the types of print media onto which printing may be done. Because the traditional printers need to identify the type and shape of the medium, they generally need to control the medium—namely by passing the medium through the body of the printer. This limits the printer's capabilities to generally fiat, thin, or watermarked print surfaces.

Mobile printers may replace the costly and burdensome mechanical positioning control asks with position and motion estimation tasks, as well as motion-aware adaptive nozzle firing controls. Doing so may allow the elimination of the need to control the printing medium, and allow printers to be compact, portable, untethered, and printable on a greater variety of surfaces. Furthermore, mobile printers may allow printing at arbitrary orientations and allow handheld operation.

Technology to determine the absolute position of a hand-manipulated device are mostly associated with inexpensive ultrasound stylus technologies that support tablet and whiteboard applications. However, commercial ultrasound positioning technologies typically provide accuracies far from that needed for high quality printing applications. Furthermore, typical ultrasound technologies provide relatively infrequent updates, and suffers from high latencies in communicating those updates.

Figure 1:
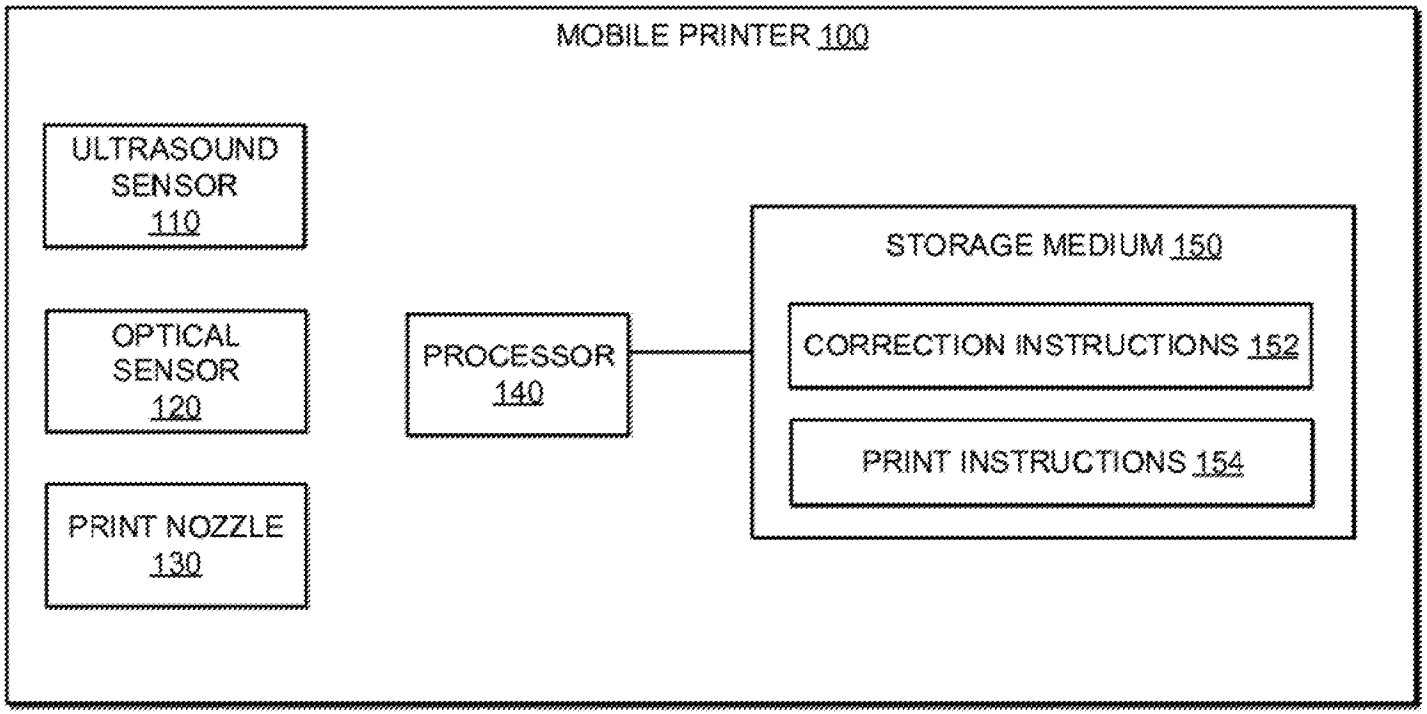
FIG. 1 is a block diagram of an example mobile printer.

Examples described herein provide for compact, portable, and precise mobile printers. In example implementations, a mobile printer includes an ultrasound sensor to sense a set of ultrasonically-sensed positional data points of a print nozzle of the printer, at least one optical sensor to sense a set of optically-sensed positional data points of the print nozzle, and a processor. The processor is to apply a correction function on the set of ultrasonically-sensed positional data points and on the set of optically-sensed positional data points to provide a set of corrected positional data points of the print nozzle and is to cause the print nozzle to deposit according to a print request and according to the set of corrected positional data points. By printing according to the set of corrected positional data points, example mobile printers may effectively self-position itself in order to accurately print an image on a printing medium, Referring now to the figures, FIG. 1 depicts an example mobile printer 100, which may include an ultrasound sensor 110, at least one optical sensor 120, a print nozzle 130, a processor 140, and a machine-readable storage medium 150. Ultrasound sensor 110 may sense a set of ultrasonically-sensed positional data points of print nozzle 130. Optical sensor 120 may sense a set of optically-sensed positional data points. Storage medium 150 may be encoded with correction instructions 152 and print instructions 154. Instructions encoded in storage medium 150 may be executable by processor 140

Mobile printer 100 may be an electrical device, such as a computer peripheral, which may make a human-readable representation of graphics or text on paper or similar physical media. Mobile printer 100 may be portable, compact, and agile and may be operated by moving the printer across a desired printing surface. For a mobile printer to effectively print an image, the location of a print nozzle, from which ink is to be deposited onto the medium, needs to be known. In the case of mobile printers, the location of the printer itself can provide the location of print nozzle. The precise location of mobile printer 100 may be determined by operations described herein.

Ultrasound sensor 110 may be a device or a system of devices that ultrasonically senses positional information of the sensor. Ultrasound sensor 110 may include a transmitter, a receiver, a transceiver, a transducer, and/or other devices and may collect a set of ultrasonically-sensed positional data points. For example, ultrasound sensor 110 may transmit a signal to a fixed receiver to determine its absolute position at the time of the transmission. Alternatively, transmitters may transmit a signal to be received by ultrasound sensor 110, which may translate the signal to position of the sensor. In some examples, ultrasound sensor 110 may include multiple parts or devices. For example, dual receiving transducers may measure the difference in signal transmission delays from a fixed transmitter to each receiver. In some implementations the positional data points sensed by ultrasound sensor 110 may be compiled or collected into a set of ultrasonically-sensed positional data points, which may be used to direct the printing operation of mobile printer 100. Ultrasound sensor 110 may communicate the sensed positional data to processor 140.

Optical sensor 120 may be a device or a system of devices that optically senses positional information of the sensor. Optical sensor 120 may sense relative movement by analyzing sequential surface images. For example, optical sensor 120 may use an optical signal, such as a laser, to sense movement across a surface. The movement may be translated by the optical sensor to a change in relative position of mobile printer 100. Optical sensor 120 may be similar to the optical or laser sensors utilized in computer mice. For example, high performance gaming mouse devices may measure micro-motions of as little as 0.1 mil. This translates to a resolution of 10,000 measurements per inch. In some implementations, the positional data points sensed by optical sensor 120 may be compiled or collected into a set of optically-sensed positional data points, which may be used to direct the printing operation of mobile printer 100. Optical sensor 120 may communicate the sensed positional data to processor 140.

Processor 140 may be one or more central processing units (CPUs), semiconductor-based microprocessors, and/or other hardware devices suitable for execution of correction instructions 152 and print instructions 154. For example, processor 140 may a part of mobile printer 100 and may be housed within the device. In other examples, processor 140 may be located elsewhere and may remotely control the operation of mobile printer 100.

Storage medium 150 may be any electronic, magnetic, optical, or other physical storage device that contains or stores machine-executable instructions. Thus, storage medium 150 may be, for example, Random Access Memory (RAM), an Electrically Erasable Programmable Read-Only Memory (EEPROM), a storage device, an optical disc, and the like. As described in detail below, storage medium 150 may be encoded with correction instructions 152 and print instructions 152.

Processor 140 may execute correction instructions 152 to apply a correction function on the set of ultrasonically-sensed positional data points and on the set of optically-sensed positional data points to provide a set of corrected positional data points. The correction function may execute a number of processes to provide the set of corrected positional data points. For example, in forming the set of corrected positional data points, the correction function may treat the set of ultrasonically-sensed positional data points as primary data points. The precision of the set of ultrasonically-sensed positional data points may be constrained by the frame rate of the positional data captured by ultrasound sensor 110. To improve precision, processor 140 may apply the correction function to interpolate using the set of optically-sensed positional data point to fill in any gaps or anomalies in the ultrasonically-sensed positional data.

In addition or as an alternative, the correction function may treat the set of optically-sensed positional data points as the primary data points. While optical sensor 120 can sense relative movement and position, it may not be able to determine absolute position without calibration. Accordingly, processor 140 may apply a calibration function on the set of ultrasonically-sensed positional data points and on the set of optically-sensed positional data points to provide the set of corrected positional data points. In some implementations, the set of optically-sensed positional data points may contain more data points than the set of ultrasonically-sensed positional data points. In other words, optically-sensed positional data points may be measured at a higher rate than ultrasonically-sensed positional data points. In such instances, the set of corrected positional data points may be formed by combining the two sets of data points, whereby the primary combined data points are made of the motion-sensed data points and where the ultrasonically-sensed data points serve to calibrate the absolute position at less frequent intervals.

Furthermore, additional processes may be used when providing the set of corrected positional data points. For example, linear state estimators such as Kalman filters may be used to fuse the sets of positional data points into the more accurate set of corrected positional data points.

In some implementations, the set of corrected positional data points may be more precise and/or have a higher resolution than either or both of the set of ultrasonically-sensed positional data points and the set of optically-sensed positional data points. In some examples, the set of corrected positional data points may have positional accuracy of up to 1 mil.

When a set of corrected positional at a points is available, processor 140 may execute print instructions 154 to cause print nozzle 130 to deposit ink according to a print request and according to the set of the corrected positional data points. Print nozzle 130 may be the part of mobile device 100 from which the printing is done. For example, print nozzle 130 may be included on a printhead and may have a valve from which ink can be deposited from the printer onto a surface, Mobile printer 100 may accurately print images by knowing the precise location of print nozzle 130 in order to properly deposit ink to form the to-be-printed image of the print request. The print request may be generated by a user from a computing device, such as mobile phone or tablet device. Upon receiving the print request, mobile printer 100 may be moved, such as by a user, across a desired printing surface to print the image of the print request.

Figure 2:
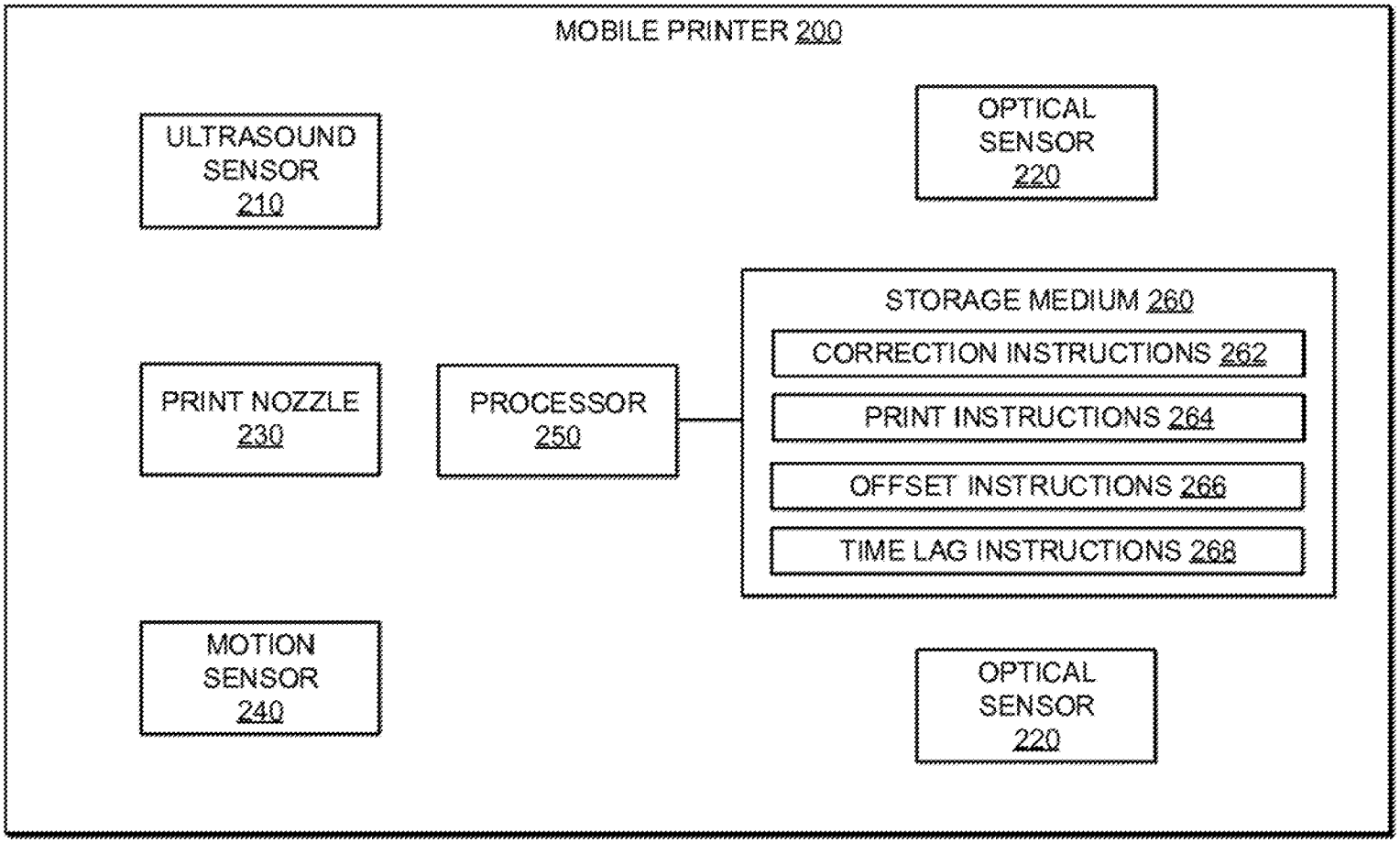
FIG. 2 is a block diagram of an example mobile printer including a plurality of optical sensors end a motion sensor.

FIG. 2 depicts an example mobile printer 200 including a plurality of optical sensors 220 and a motion sensor 240. Mobile printer 200 may also include an ultrasound sensor 210, a print nozzle 230, a processor 250, and a machine-readable storage medium 260. Ultrasound sensor 210 may sense a set of ultrasonically-sensed positional data points of print nozzle 234. Optical sensors 220 may sense a set of optically-sensed positional data points. Motion sensor 240 may detect rapid movements of mobile printer 200. Machine-readable storage medium 260 may be encoded with correction instructions 262, print instructions 264, offset instructions 266, and time lag instructions 268. Instructions encoded in storage medium 260 may be executable by processor 250.

Mobile printer 200 may be similar to mobile printer 100. Ultrasound sensor 210 may be analogous with ultrasound sensor 110, optical sensors 220 may be analogous with optical sensor 120, print nozzle 230 may be analogous with print nozzle 130, processor 250 may be analogous with processor 140, and storage medium 260 may be analogous with storage medium 150.

Mobile printer 200 may include a plurality of optical sensors 220. In the example shown in FIG. 2, mobile printer 200 includes dual optical sensors 220 that may sense rotation of the printer. In such examples, the distance between the two optical sensors is known and measuring the change in position of the two optical sensors allows the calculation of the rotation of the mobile printer 200. The rotation of the printer may account for the typical movement of a user moving the printer with a typical arm swipe.

Additionally, mobile printer 200 may include motion sensor 240 to sense rapid movement, such as undesired reversal of direction or when the printer is lifted off of the printing surface. Motion sensor 240 may be a number of devices that can sense inertial movements. Examples of motion sensor 240 include gyroscopes and accelerometers. Motion sensor 240 may serve multiple purposes, including supplementing the set of ultrasonically-sensed positional data points and the set of optically-sensed positional data points to provide a more accurate set of corrected positional data points. Alternatively or in addition, motion sensor 240 may prevent printing errors by notifying the processor of sudden, undesirable changes in the location of the printer.

Processor 250 may execute the instructions of storage medium 260, including correction instructions 262, print instructions 264, offset instructions 266, and time lag instructions 268. Prior to or during printing, processor 250 may execute offset instructions 266 to determine an offset between print nozzle 230 and an optical sensor 220. Because optical sensor 220, which captures the absolute location of the sensor, may not be in the same exact location within mobile printer 200 as the print nozzle 230 from which the ink is deposited, the offset should be determined to accurately locate print nozzle 230 relative to the sensed location of optical sensor 220. When executing correction instructions 262 and/or print instructions 264, processor 250 may use the offset to accurately position print nozzle 230.

Furthermore, processor 250 may execute time lag instructions 268 prior to or during printing. Time lag instructions 268 may determine a time lag between the print request and the depositing of the ink and to compensate for the time lag by applying an extrapolation function. Due to the high precision of the positional data needed to print an accurate image, the small lag between the print request and the depositing of the ink can affect the print quality. An extrapolation function can account for the time lag, but unpredictability of the printer motion, such as that caused by jerkiness of the user's hand, complicates the extrapolation. To account for such instances, time lag instructions 268 may determine the position and speed of the mobile printer 200 based on kinematic equations. Accordingly, time lag instructions 268 may cause print nozzle 230 to deposit ink only when previous samples from the position sensors indicate the mobile printer is moving at an acceptable rate (i.e., acceleration and irregularity are below a defined threshold).

Figure 3:
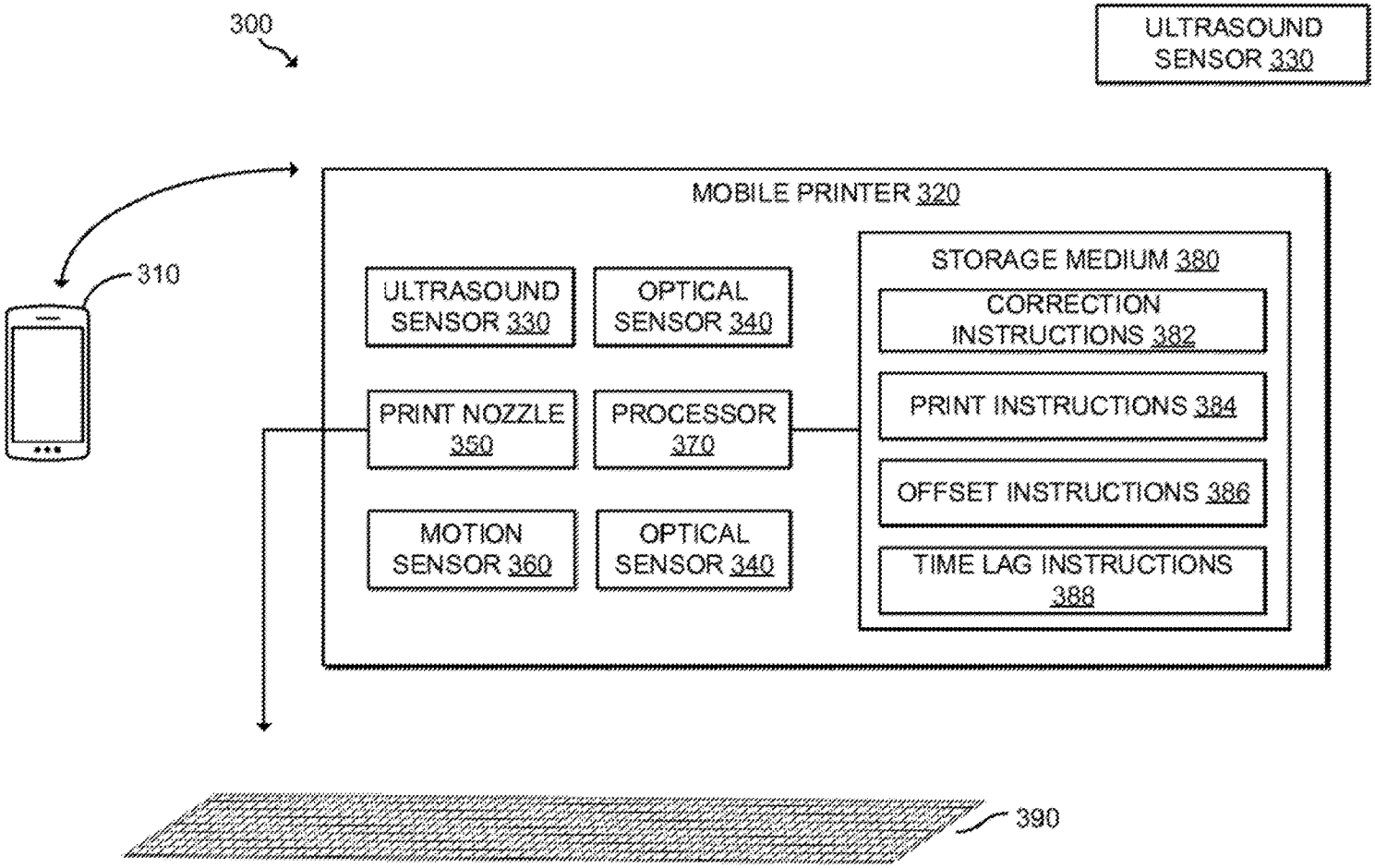
FIG. 3 is a diagram of an example system include a computing device, a mobile printer, and printing medium.

FIG. 3 depicts an example system 300 including a computing device 310, a mobile printer 320, and printing medium 390. Computing device 310 may generate a print request that is sent to mobile printer 320. Mobile printer 320 may print requested image onto a printing surface of printing medium 390. As described herein, mobile printer 320 may self-position itself during the printing process in order to accurately satisfy the print request.

Computing device 310 may be any electronic device with which a user may generate a print request. Computing device 310 may be a handheld mobile device, such as cellphones and tablets or stationery machines such as desktop computers, servers, and other types of systems. The print request may be communicated to mobile printer 120 by any number of means, including wirelessly such as via Bluetooth or a wireless network.

Mobile printer 320 may be similar to mobile printer 200 of FIG. 2. Mobile printer 320 may include ultrasound sensor 330, optical sensor 340, print nozzle 350, motion sensor 360, processor 370, and storage medium 380. Storage medium 380 may be encoded with correction instructions 382, print instructions 384, offset instructions 386, and time lag instructions 388, which may be executed by processor 370.

Furthermore, FIG. 3 shows an additional ultrasound sensor 330 located outside of the printer. This illustrates examples where the one or more ultrasound sensors inside the printer communicates with one or more ultrasound sensors outside the printer to sense the absolute location of mobile printer 320. For example, the ultrasound sensor 330 outside may transmit a signal to be received by the ultrasound sensor inside the printer. Alternatively, the sensor inside the printer may transmit a signal to be received by the sensor outside of the printer. The ultrasound sensor 330 outside the printer may be stationery in order to serve as a reference point for determining the location of mobile printer 320 relative to the print medium.

Mobile printer 320 may operate to print the image of the print request onto printing medium 390. Printing medium 390 may have a printing surface onto which the image is to be printed. Due to the self-positioning ability of mobile printer 320, printing medium 390 may not be constrained to smooth, flat surfaces such as paper or similar media. For example, print medium 320 may include unconventional media such as wails, shipping boxes, clothing, or skin. Additionally, print medium 320 may also include traditional media such as papers.

Figure 4:
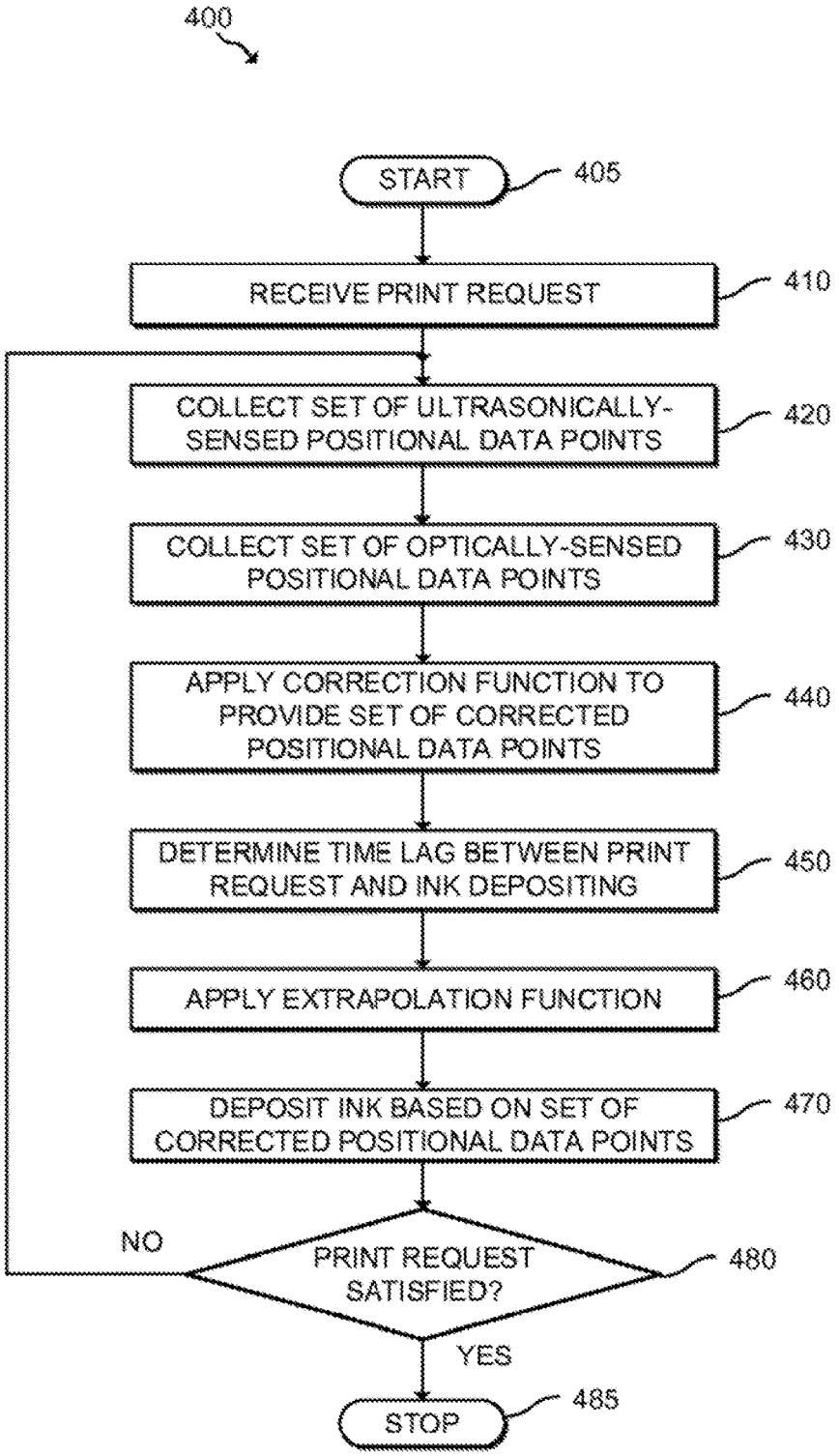
FIG. 4 is a flowchart of an example method to print according to a print request.

FIG. 4 is a flowchart depicting an example method 400 to print according to a print request Although execution of method 400 is described below with reference to system 300 of FIG. 3, other suitable candidates for execution of method 400 should be apparent, including mobile printer 100 of FIG. 1 and mobile printer 200 of FIG. 2. Additionally, method 400 and variations thereof, as well as the functions and processes described above and variations thereof, may be performed by hardware logic, such as application specific integrated circuits Method 400 may start in block 405 and proceed to block 410, where mobile printer 320 receives a print request from computing device 314. As described previously, the print request may include an image to be printed by mobile printer 320. The print request may be created by a user and communicated to mobile printer 320.

After receiving the print request, method 400 may proceed to block 420, where mobile printer 320 collects a set of ultrasonically-sensed positional data points. The set of ultrasonically-sensed positional data points may be sensed by ultrasound sensors 330. After collecting the set of ultrasonically-sensed positional data points, method 400 may proceed to block 430, where mobile printer 320 collects a set of optically-sensed positional data points, which may be sensed by optical sensors 340.

After collecting the sets of positional data points, method 400 may proceed to block 440, where a correction function is applied to the set of ultrasonically-sensed positional data points and to the set of optically-sensed positional data points to provide a set of corrected positional data points. By combining the two sets of positional data points, the corrected set of positional data points may be more precise than either of the individual sets. In some examples, the correction function may include a calibration function that adjusts the set of ultrasonically-sensed positional data points and the set of optically-sensed positional data points.

After providing a set of corrected positional data points, method 400 may proceed to block 450, where a time lag is determined between the time the current position is determined and the depositing of ink. While the time lag may be small, even a minute lag may affect the quality of prints, especially those with high resolutions. In some implementations, the time lag may be between the time of the print request and the time of the depositing of ink.

After determining the time lag method 400 may proceed to block 460, where an extrapolation function is applied to compensate for the time lag. The extrapolation function can account for the time lag, but unpredictability of the printer motion, such as caused by jerkiness of the user's hand, complicates the extrapolation. To account for such instances, the extrapolation function may determine the position and speed of mobile printer 320 based on kinematic equations. Accordingly, in some implementations, method 400 may proceed to block 470 to deposit ink only when previous samples from the position sensors indicate the mobile printer 320 is moving at an acceptable rate (Le., acceleration and irregularity are below a defined threshold).

It should be noted that blocks 420, 430, 440, 450, and 460 may be performed in different orders with the same intended result. For example, the time lag may be determined and the extrapolation function applied prior to the providing the set of corrected positional data points.

After applying the extrapolation function, method 400 may proceed to block 470, where mobile printer 320 may deposit ink via print nozzle 350. Mobile printer 320 may deposit ink according to the print request and according to the set of corrected positional data points. Doing so allows the printing of a piece of the image of the print request. Multiple iterations of blocks 420 through 470 can produce the complete intended printed product.

After depositing ink, method 400 may proceed to block 480, where mobile printer 320 may check whether the print request has been satisfied. In other words, if the requested image has been fully printed. If the print request has not been satisfied, method 400 may return to block 420 to continue the printing process. Alternatively, if block 480 determines that the print request is satisfied, that is if the image has been completely printed, method 400 may proceed to block 485 where the method stops.

What is claimed is:

1. A mobile printer, comprising:

an ultrasound sensor to sense a set of ultrasonically-sensed positional data points of a print nozzle of the printer as the mobile printer is moved a direction across a printing surface;

an optical sensor to sense a set of optically-sensed positional data points of the print nozzle of the printer when the mobile printer is moved the direction across the printing surface;

a motion sensor; and a processor to:

apply a correction function on the set of ultrasonically-sensed positional data points and on the set of optically-sensed positional data points to provide a set of corrected positional data points of the print nozzle of the printer;

cause the print nozzle to deposit ink according to a print request according to the set of corrected positional data points and information received from the motion sensor corresponding to a change in a location of the printer;

identify information from the motion sensor about a reversal of the direction across the printing surface;

compensate for a first time lag caused by the reversal of the direction based on a position and a speed of the printer included in the identified information about the reversal of the direction; and supplement the set of ultrasonically-sensed positional data points with the identified information about the reversal of the direction in response to receiving a notification from the motion sensor about the reversal of the direction, wherein the notification prevents printing errors by increasing an accuracy of the set of corrected positional data points.

2. The printer of claim 1, wherein the motion sensor is to sense rapid motion of the printer.

3. The printer of claim 1, wherein the optical sensor is to sense rotation of the printer.

4. The printer of claim 1, wherein the correction function provides the set of corrected positional data points by applying a calibration function on the set of ultrasonically-sensed positional data points and on the set of optically-sensed positional data points.

5. The printer of claim 1, wherein the processor is to determine a second time lag between the print request and the depositing of the ink and to compensate for the second time lag by applying an extrapolation function.

6. The printer of claim 1, wherein the processor is to determine an offset between the print nozzle and the optical sensor, and wherein the processor is to apply the correction function according to the offset.

7. The printer of claim 1, wherein the set of corrected positional data points has an accuracy of up to 1 mil.

8. The printer of claim 1, wherein the processor is to further apply the correction function based on the information corresponding to the change in the location of the printer.

9. A mobile printer, comprising:

an ultrasound sensor to sense a set of ultrasonically-sensed positional data points of a print nozzle as the mobile printer is moved a direction across a printing surface;

a plurality of optical sensors to sense a set of optically-sensed positional data points of the print nozzle when the mobile printer is moved the direction across the printing surface;

a motion sensor; and a processor to:

receive a print request from a computing device;

determine an offset between the print nozzle and the plurality of optical sensors;

apply a calibration function, according to the offset, on the set of ultrasonically-sensed positional data points, the set of optically-sensed positional data points, and information received from the motion sensor corresponding to a motion of the printer to provide a set of corrected positional data points of the print nozzle of the printer;

cause the print nozzle to deposit ink according to a print request and to the set of corrected positional data points;

identify information from the motion sensor about a reversal of the direction across the printing surface;

compensate for a first time lag caused by the reversal of the direction based on a position and a speed of the printer included in the identified information about the reversal of the direction; and supplement the set of ultrasonically-sensed positional data points with the identified information about the reversal of the direction in response to receiving a notification from the motion sensor about the reversal of the direction, wherein the notification prevents printing errors by increasing an accuracy of the set of corrected positional data points.

10. The printer of claim 9, wherein the motion sensor is to detect rapid motion of the print nozzle.

11. The printer of claim 9, wherein the plurality of optical sensors is to measure rotation of the print nozzle.

12. The printer of claim 9, wherein the processor is to determine a second time lag between the print request and the depositing of the ink and to compensate for the second time lag by applying an extrapolation function.

13. The printer of claim 9, wherein the set of corrected positional data points has an accuracy of up to 1 mil.

14. The printer of claim 9, wherein the processor is to further receive information corresponding to a change in a location of the printer from the motion sensor.

15. The printer of claim 14, wherein the processor is to further cause the print nozzle to deposit ink according to the information corresponding to the change in the location of the printer.

16. A method of printing, comprising:

receiving a print request;

collecting a set of ultrasonically-sensed positional data points of a print nozzle as the mobile printer is moved a direction across a printing surface;

collecting a set of optically-sensed positional data points of the print nozzle when the mobile printer is moved the direction across the printing surface;

collecting information corresponding to a motion of the printer from a motion sensor;

applying a correction function on the set of ultrasonically-sensed positional data points, the set of optically-sensed positional data points, and the information corresponding to the motion of the printer to provide a set of corrected positional data points of the print nozzle;

depositing ink according to the print request and the set of corrected positional data points;

identifying information from the motion sensor about a reversal of the direction across the printing surface;

compensating for a first time lag caused by the reversal of the direction based on a position and a speed of the printer included in the identified information about the reversal of the direction; and supplementing the set of ultrasonically-sensed positional data points with the identified information about the reversal of the direction in response to receiving a notification from the motion sensor about the reversal of the direction, wherein the notification prevents printing errors by increasing an accuracy of the set of corrected positional data points.

17. The method of claim 16, comprising:

determining a second time lag between a print request and the depositing of the ink; and applying an extrapolation function to compensate for the second time lag.

18. The method of claim 16, wherein the correction function applies a calibration function on the set of ultrasonically-sensed positional data points and on the set of optically-sensed positional data points.

19. The method of claim 16, wherein the motion of the printer corresponds to a sudden, undesirable change in a location of the printer.

20. The method of claim 16, wherein the set of optically-sensed positional data points includes data points corresponding to a rotation of the print nozzle.

* * * * *